US009374637B2

(12) United States Patent
Shao et al.

(10) Patent No.: US 9,374,637 B2
(45) Date of Patent: Jun. 21, 2016

(54) ELECTRONIC SYSTEM AND ELECTRONIC DEVICE THEREOF

(71) Applicant: HTC Corporation, Taoyuan County (TW)

(72) Inventors: Yen-Chun Shao, Taoyuan County (TW); Chih-Chiang Lin, Taoyuan County (TW); Wen-Yu Shih, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 183 days.

(21) Appl. No.: 14/166,862

(22) Filed: Jan. 29, 2014

(65) Prior Publication Data

US 2015/0071471 A1 Mar. 12, 2015

Related U.S. Application Data

(60) Provisional application No. 61/874,365, filed on Sep. 6, 2013.

(51) Int. Cl.

| | |
|---|---|
| ***H04R 1/02*** | (2006.01) |
| ***H04R 1/28*** | (2006.01) |
| *H04R 1/26* | (2006.01) |

(52) U.S. Cl.

CPC ..... *H04R 1/2811* (2013.01); *H04R 1/26* (2013.01); *H04R 2205/021* (2013.01); *H04R 2420/07* (2013.01); *H04R 2430/01* (2013.01); *H04R 2499/11* (2013.01)

(58) Field of Classification Search

CPC ..... H04R 5/02; H04R 5/023
USPC ..... 381/87, 332–334, 335, 386
See application file for complete search history.

(56) References Cited

U.S. PATENT DOCUMENTS

| | | | | |
|---|---|---|---|---|
| 6,813,528 | B1 * | 11/2004 | Yang | G06F 1/1632 381/306 |
| 7,110,249 | B2 * | 9/2006 | Nakatani | G06F 1/1616 361/679.21 |
| 7,777,450 | B2 * | 8/2010 | Lee | H02J 7/0044 320/115 |
| 8,971,560 | B2 * | 3/2015 | Lyons | H04R 1/026 381/334 |
| 2008/0025542 | A1 * | 1/2008 | Lee | H04M 1/035 381/334 |
| 2011/0110548 | A1 * | 5/2011 | Yeh | H04M 1/0216 381/334 |
| 2013/0094687 | A1 * | 4/2013 | Weinstein | H04R 1/10 381/334 |
| 2013/0259283 | A1 | 10/2013 | Gengler et al. | |
| 2013/0343568 | A1 | 12/2013 | Mayman et al. | |
| 2014/0112494 | A1 * | 4/2014 | Lee | F16M 13/00 381/77 |

* cited by examiner

*Primary Examiner* — Disler Paul
(74) *Attorney, Agent, or Firm* — Jianq Chyun IP Office

(57) ABSTRACT

An electronic system and an electronic device thereof are provided. The electronic device includes a first housing, a speaker module, a second housing, and a bearing. The first housing has a first hole. The speaker module is disposed in the first housing, and a sound generated by the speaker module is transmitted out of the electronic device through the first hole. The second housing has a bearing surface facing to the first housing. The bearing is disposed between the first housing and the second housing. The second housing and the first housing move relative to each other by using the bearing, so the first housing covers or exposes a portion of the bearing surface.

16 Claims, 6 Drawing Sheets

ELECTRONIC SYSTEM AND ELECTRONIC DEVICE THEREOF

CROSS-REFERENCE TO RELATED APPLICATION

This application claims the priority benefits of U.S. provisional application Ser. No. 61/874,365, filed on Sep. 6, 2013. The entirety of the above-mentioned patent application is hereby incorporated by reference herein and made a part of this specification.

BACKGROUND OF THE INVENTION

1. Field of the Invention

The invention relates to an electronic system and an electronic device thereof. More particularly, the invention relates to an electronic system and an electronic device there of having a speaker module.

2. Description of Related Art

Generally speaking, a loudspeaker includes an acoustic enclosure and a speaker. The acoustic enclosure includes a resonant chamber, and the speaker is disposed in the resonant chamber of the acoustic enclosure. In operation, the sound generated by the speaker produces resonance through the resonant chamber of the acoustic enclosure, the acoustic enclosure thereby achieving the effect of sound amplification. However, the user is typically limited by the size of the acoustic enclosure, and the loudspeaker is inconvenient to carry. Besides, when a user plays back audio data from a handheld electronic device with the loudspeaker, the user does not know how to place the handheld electronic device around the loudspeaker. Therefore, in loudspeaker design, it is important to enhance the convenience of using the loudspeaker.

SUMMARY OF THE INVENTION

The invention provides an electronic system and an electronic device thereof having a speaker module disposed in a first housing, and capable of using a bearing to drive a second housing and the first housing to move relative to each other. Accordingly, when a portion of a bearing surface of the second housing is exposed due to the relative movements of the two housings, a handheld electronic device may be suitably placed on the bearing surface, thereby enhancing the convenience of using the electronic device.

The electronic device in the invention includes a first housing, a speaker module, a second housing, and a bearing. The first housing has a first hole. The speaker module is disposed in the first housing, and a sound generated by the speaker module is transmitted out of the electronic device through the first hole. The second housing has a bearing surface facing to the first housing. The bearing is disposed between the first housing and the second housing. Moreover, the second housing and the first housing move relative to each other by using the bearing, so that the first housing covers or exposes a portion of the bearing surface.

An electronic system in the invention includes the electronic device and the handheld electronic device. The electronic device includes a first housing, a speaker module, a second housing, a bearing, a first wireless module, and a first processing unit. The first housing has a first hole. The speaker module is disposed in the first housing, and a sound generated by the speaker module is transmitted out of the electronic device through the first hole. The second housing has a bearing surface facing to the first housing. The bearing is disposed between the first housing and the second housing. Moreover, the bearing drives the second housing and the first housing to move relative to each other, so that the first housing covers or exposes a portion of the bearing surface of the second housing. The first wireless module receives a first wireless signal having an audio data. The first processing unit is coupled to the first wireless module and the speaker module, and the first processing unit processes the audio data to generate a sound signal, wherein the speaker module generates the sound according to the sound signal. The handheld electronic device includes a second processing unit and a third wireless module. The second processing unit generates the audio data. The third wireless module is coupled to the second processing unit, and the third wireless module generates the first wireless signal.

In summary embodiments of the invention employ the bearing to drive the first housing and the second housing to slide relative to each other, so that the electronic device can selectively expose a portion of the bearing surface of the second housing. Moreover, the exposed bearing surface in the electronic device is suitable for placing a handheld electronic device, and the protrusion disposed on the bearing surface may be used to stop the handheld electronic device from sliding out of the edge of the bearing surface, thereby enhancing the convenience of using the electronic device.

To make the above features and advantages of the invention more comprehensible, several embodiments accompanied with drawings are described in detail as follows.

BRIEF DESCRIPTION OF THE DRAWINGS

The accompanying drawings constituting a part of this specification are incorporated herein to provide a further understanding of the disclosure. Here, the drawings illustrate embodiments of the disclosure and, together with the description, serve to explain the principles of the disclosure.

DESCRIPTION OF EMBODIMENTS

Figure 1:
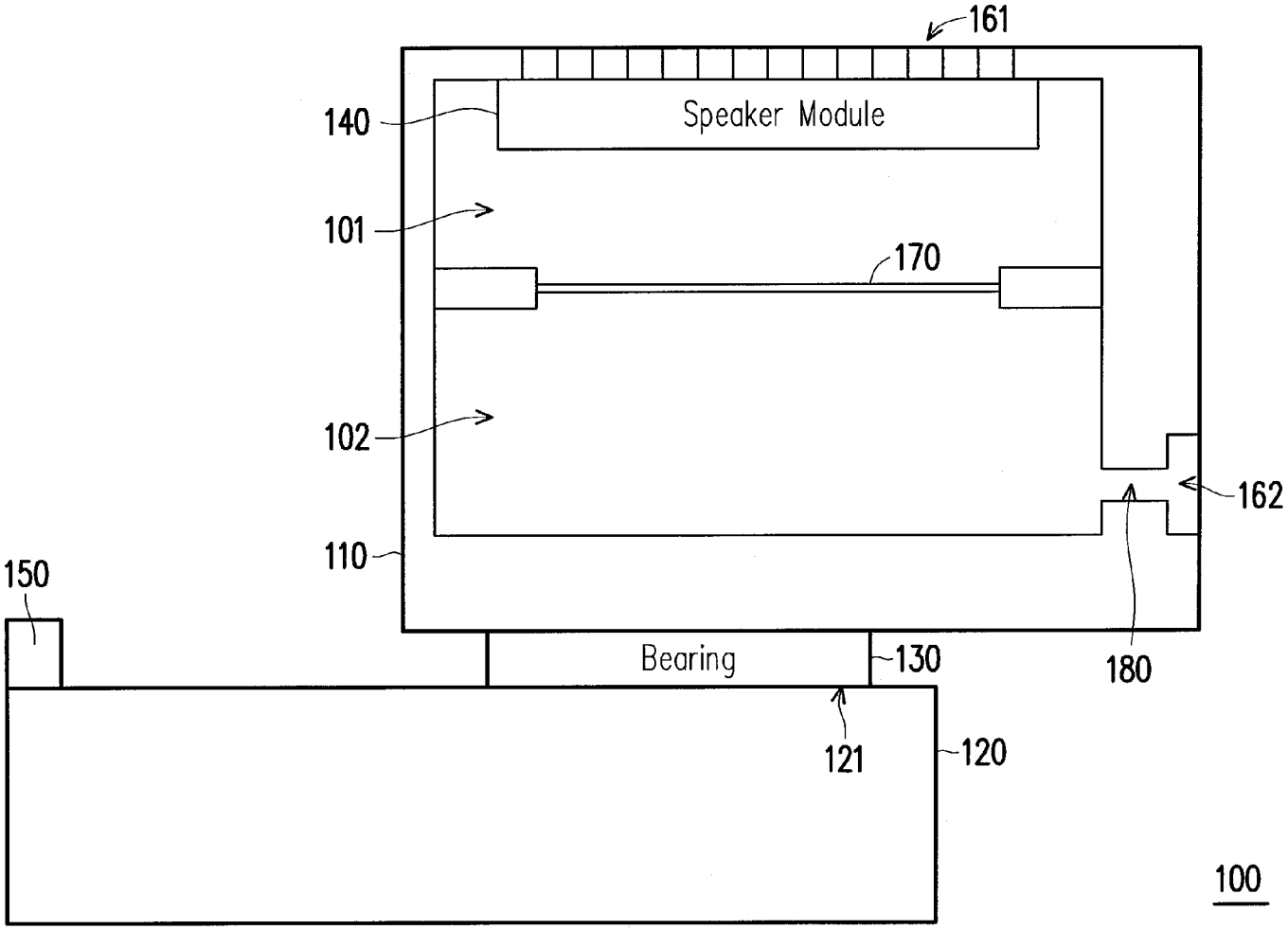
FIG. 1 is a schematic structural view of an electronic device according to an embodiment of the invention.

FIG. 1 is a schematic structural view of an electronic device according to an embodiment of the invention. An electronic device 100 may be a device capable of converting electrical energy into sound energy. For example, the electronic device 100 may generate sound (e.g. sound waves), and the electronic device 100 may be a loudspeaker, a subwoofer, or an electro-acoustic transducer, for instance.

The electronic device 100 includes a first housing 110, a second housing 120, a bearing 130, a speaker module 140, and a protrusion 150. The first housing 110 and the second housing 120 has a three-dimensional outer appearance. For example, the first housing 110 depicted in FIG. 1 has six side surfaces. Moreover, a side surface of the first housing 110 has a first hole 161. The first hole 161 penetrates the side surface of the first housing, and the first hole 161 may be an opening or a plurality of holes penetrating the first housing 110. The speaker module 140 is disposed in the first housing 110 and covers the first hole 161. Furthermore, the electronic device 100 converts electric energy to sound energy through the speaker module 140, and a sound generated by the speaker module 140 may be transmitted out of the first housing 110 through the first hole 161.

The bearing 130 is disposed between the first housing 110 and the second housing 120. In addition, the second housing 120 may move or slide relative to the first housing 110 by using the bearing 130. For example, the second housing 120 may slide below the first housing 110 by using the bearing 130, so as to close with the first housing 110. Moreover, the second housing 120 may also slide out from below the first housing 110 by using the bearing 130, so as to be expanded with the first housing 110. In other words, the first housing 110 and the second housing 120 may move relative to each other by using the bearing 130, so as to from a closed state or an expanded state.

The second housing 120 has a bearing surface 121 facing to the first housing 110. When the second housing 120 slides below the first housing 110, that is, when the first housing 110 and the second housing 120 are in the closed state, a portion of the bearing surface 121 of the second housing 120 is covered by the first housing 110. On the other hand, when the second housing 120 slides out from below the first housing 110, that is, when the first housing 110 and the second housing 120 are in the expanded state, a portion of the bearing surface 121 of the second housing 120 is exposed. In other words, the electronic device 100 may selectively expose a portion of the bearing surface 121 of the second housing 120 by the relative movements of the first housing 110 and the second housing 120. That is, the first housing 110 and the second housing 120 may move relative to each other by using the bearing 130, so that the first housing 110 covers or exposes a portion of the bearing surface 121.

The protrusion 150 is disposed on the bearing surface 121 of the second housing 120, and the protrusion 150 is located near an edge of the bearing surface 121. In specifics, the protrusion 150 stands vertically on the bearing surface 121 of the second housing 120. That is, the protrusion 150 extends from the bearing surface 121 along a direction perpendicular to the bearing surface 121. On the other hand, the first housing 110 has a recess corresponding to the protrusion 150. Moreover, when the second housing 120 slides below the first housing 110, the protrusion 150 of the second housing 120 is embedded with the recess of the first housing 110, so that the electronic device 100 is prevented from exposing the protrusion 150 under the closed state.

Figure 2:
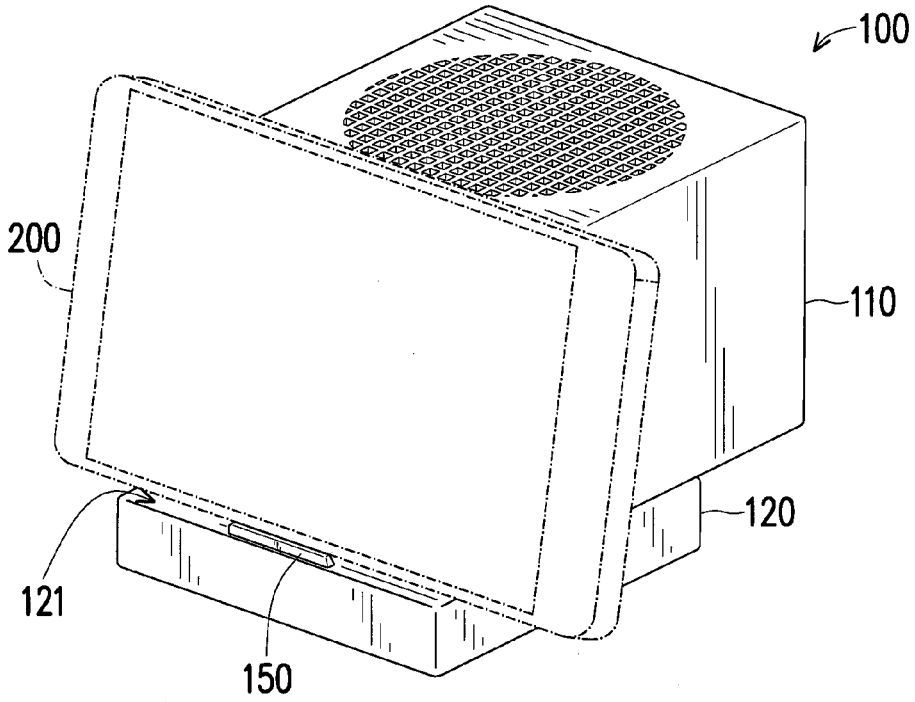
FIG. 2 is a schematic view of an electronic system in operation according to an embodiment of the invention.

In practice, the electronic device 100 may be operated with a handheld electronic device, wherein the electronic device 100 and the handheld electronic device form an electronic system, such as an interactive playback system, for instance. For example, FIG. 2 is a schematic view of an electronic system in operation according to an embodiment of the invention. As shown in FIG. 2, when the bearing surface 121 of the second housing 120 is exposed, a handheld electronic device 200 may be disposed on the bearing surface 121, and the protrusion 150 may be used to stop the handheld electronic device 200 from sliding out of the edge of the bearing surface 121. In other words, not only does the electronic device 100 have a sound playback function, the electronic device 100 can also slide out the bearing surface 121 for placing the handheld electronic device 200. Accordingly, the convenience of using the electronic device 100 is enhanced.

Please continue reference to FIG. 1. The first housing 110 includes a resonant film 170, a first resonant chamber 101 and a second resonant chamber 102. The resonant film 170 is disposed in the first housing 110 and located between the first resonant chamber 101 and the second resonant chamber 102. In other words, an internal space of the first housing 110 may be divided into the first resonant chamber 101 and the second resonant chamber 102 according to the resonant film 170. The first resonant chamber 101 is an airtight space. The second resonant chamber 102 has a channel 180, and the second resonant chamber 102 is connected to outside of the first housing 110 through the channel 180 and a second hole 162 of the first housing 110.

The speaker module 140 is located in the first resonant chamber 101. Moreover, when the speaker module 140 generates sound, the sound produced by the speaker module 140 also enters the first resonant chamber 101. The sound produced by the speaker module 140 compresses the air in the first resonant chamber 101 and causes the resonant film 170 to vibrate. Furthermore, the air inside the second resonant chamber 102 is compressed along with the vibrations of the resonant film 170. Accordingly, the electronic device 100 can also transmit another sound through the second hole 162 of the first housing 110, and thereby achieve a sound amplification effect. In particular, since the first housing 110 uses two resonant chambers 101 and 102 to generate resonance, a sound field effect of the electronic device 100 can be enhanced in a limited space, thereby facilitating the miniaturization of the electronic device 100.

Figure 3:
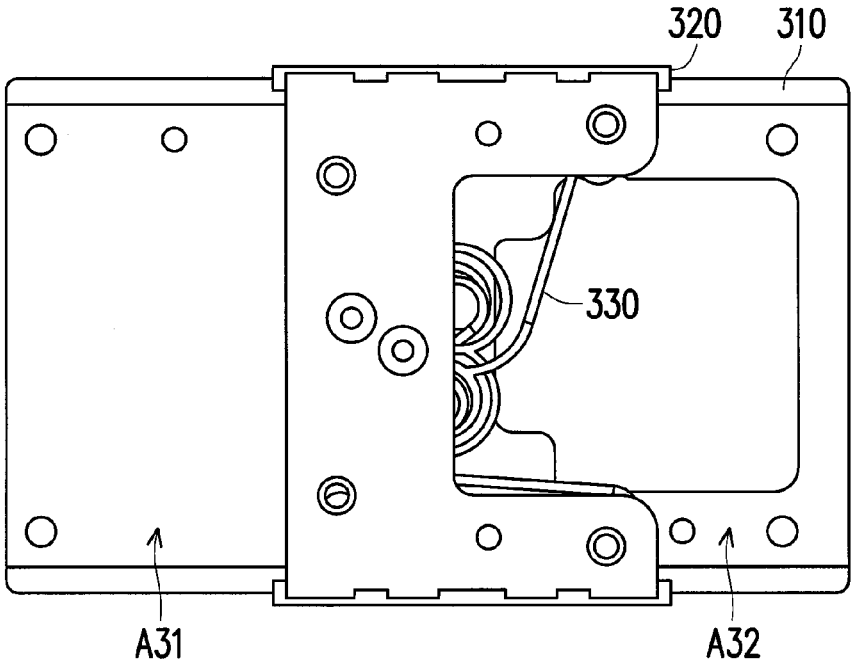
FIG. 3 is a schematic structural view of a bearing according to an embodiment of the invention.

FIG. 3 is a schematic structural view of a bearing according to an embodiment of the invention. As shown in FIG. 3, the bearing 130 includes a first sliding element 310, and a second sliding element 320, and an elastic element 330. The second sliding element 320 may slide or move between a first position A31 and a second position A32 of the first sliding element 310. The elastic element 330 is connected between the first sliding element 310 and the second sliding element 320 to provide an elastic force. The second sliding element 320 may slide or move to the first position A31 or the second position A32 by using the elastic force of the elastic element 330. In other words, the second sliding element 320 is glidingly disposed on the first sliding element 310, and the second sliding element 320 may slide to the first position A31 or the second position A32 by using the elastic force of the elastic element 330.

Moreover, in the overall configuration, the first sliding element 310 connects to the first housing 110, and the second sliding element 320 connects to the bearing surface 121 of the second housing 120. Accordingly, as the second sliding element 320 moves relative to the first sliding element 310, the first housing 110 and the second housing element 120 move relative to each other. For example, when the second sliding element 320 moves from the second position A32 to the first position A31, the second housing 120 correspondingly slides out from below the first housing 110. Furthermore, although the afore-described embodiment exemplified a structural implementation of the bearing 130, the embodiment should by no means limit the scope of the invention. For instance, the bearing 130 may also be a sliding hinge, a spring hinge, a plain bearing, a magnetic bearing, or a fluid bearing, for example.

Figure 4:
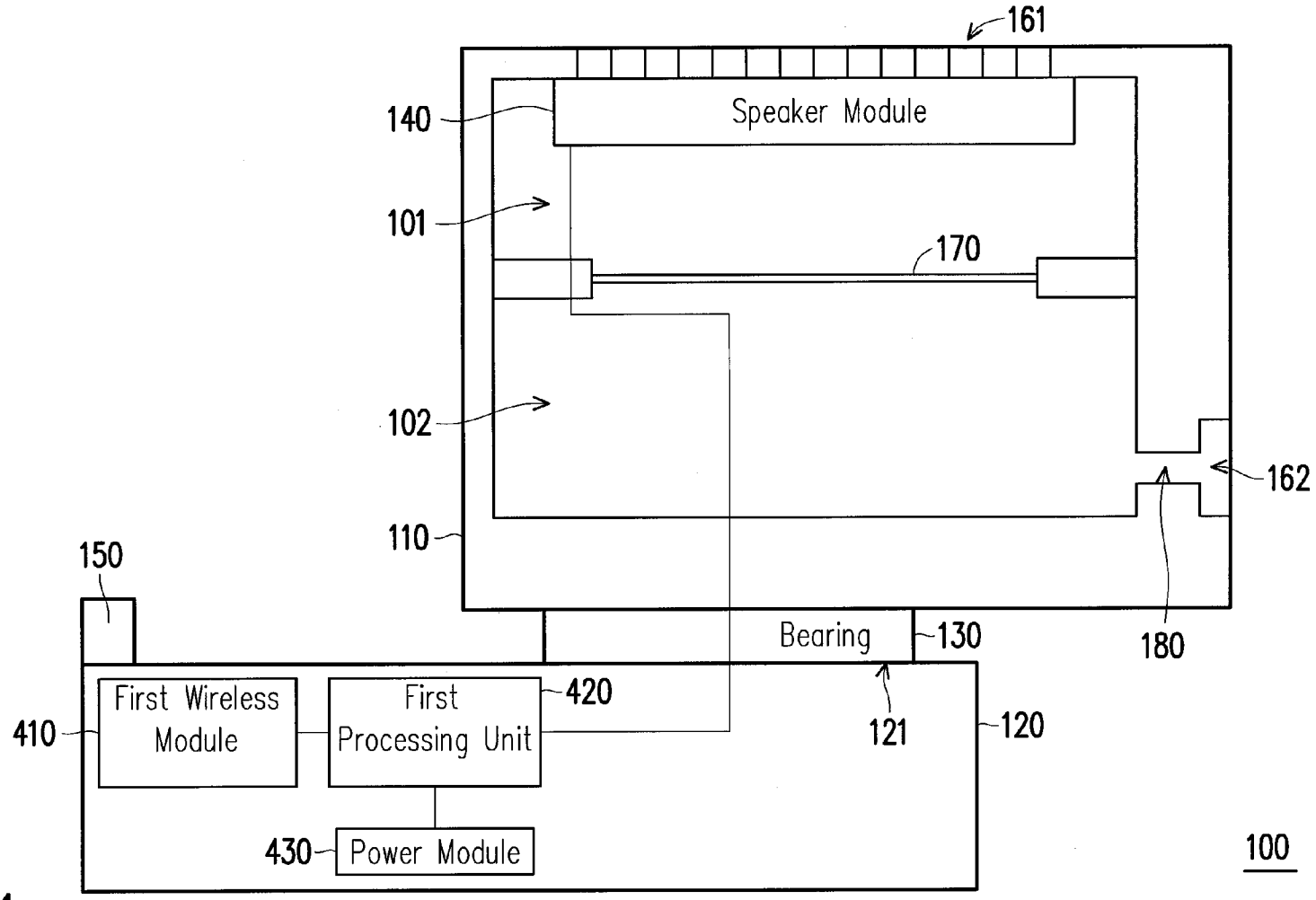
FIG. 4 is a schematic structural view of an electronic device according to another embodiment of the invention.

FIG. 4 is a schematic structural view of an electronic device according to another embodiment of the invention. The electronic device 100 depicted in FIG. 4 is an extension of the embodiment exemplified in FIG. 1. A difference between the two lies in that, the electronic device 100 in FIG. 4 further includes a first wireless module 410, a first processing unit 420, and a power module 430 disposed in the second housing 120. The first wireless module 410 and the power module are coupled to the first processing unit 420, and the first processing unit 420 is coupled to the speaker unit 140 located in the first housing 110.

The first wireless module 410 uses a first communication protocol to receive a first wireless signal having an audio data. The first communication protocol may be a Bluetooth or a wireless fidelity (Wi-Fi) protocol, for instance. Moreover, the first wireless module 410 performs operations such as filtering, down-converting, and demodulation, so as to extract the audio data in the first wireless signal. A frequency range of the audio data may cover an audible frequency range or an inaudible frequency range of human ears.

The first processing unit 420 receives the audio data from the first wireless module 410, and the first processing unit 420 process or decodes the audio data to generate a sound signal. Moreover, the first processing unit 420 transmits the sound signal to the speaker module 140 in the first housing 110. The speaker module 140 converts the sound signal into sound, and the speaker module 140 uses the resonance mechanism of the second housing 120 to achieve the preferable sound field effect. On the other hand, the power module 430 provides power to circuit elements located in the first housing 110 and the second housing 120, such as the speaker module 140, the first processing unit 420, and the first wireless module 410.

Figure 5:
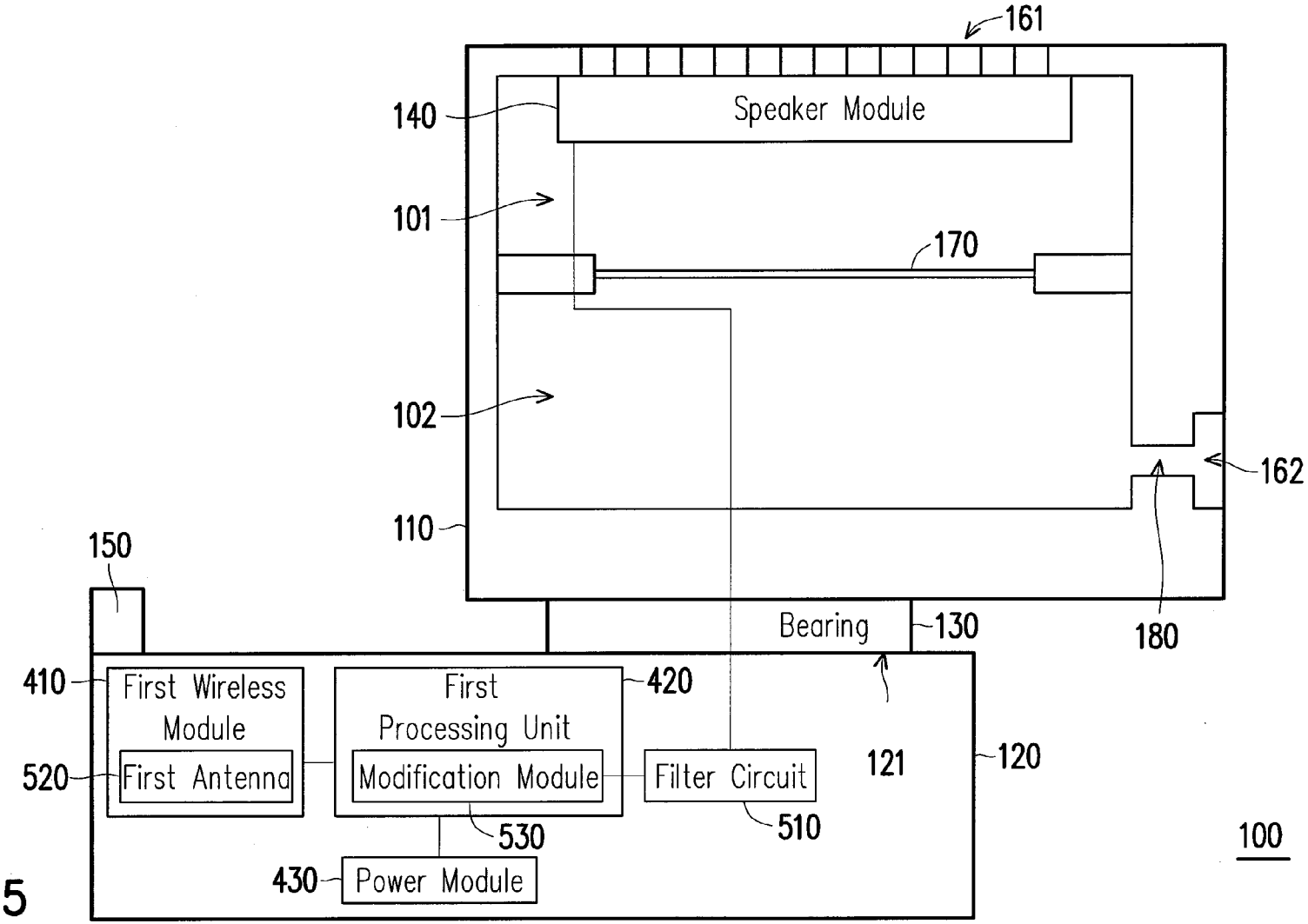
FIG. 5 is a schematic structural view of an electronic device according to another embodiment of the invention.

FIG. 5 is a schematic structural view of an electronic device according to another embodiment of the invention. The electronic device 100 depicted in FIG. 5 is an extension of the embodiment exemplified in FIG. 4. A difference between the two lies in that, the electronic device 100 in FIG. 5 further includes a filter circuit 510, the first wireless module 410 includes a first antenna 520, and the first processing unit 420 includes a modification module 530.

In specifics, the first wireless module 410 may receive the first wireless signal through the first antenna 520. The first processing unit 420 may modify data corresponding to each band or a specific band of the audio data through the modification module 530, so as to achieve a frequency compensation effect and thereby contribute to enhancing an acoustic quality of the electronic device 100. The modification module 530 may be a 3-band equalizer or a multi-band equalizer, for example. Alternatively, the modification module 530 may be a software program or a hardware circuit capable of modifying the audio data. Moreover, the modification module 530 generates the sound signal according to the modified audio data, and the modification module 530 transmits the sound signal to the filter circuit 510.

The filter circuit 510 is disposed in the second housing 120 and coupled between the speaker module 140 and the modification module 530. The filter circuit 510 performs a filtering process on the sound signal, so that the speaker module 140 may playback sound of a specific band. For example, in one embodiment, the filter circuit 510 extracts a second frequency signal from the sound signal. Furthermore, the filter circuit 510 transmits the second frequency signal to the speaker module 140, so that the speaker module 140 generates a second frequency sound. The second frequency signal may be a low frequency signal between 20 Hz-200 Hz, and the second frequency sound may be a low frequency sound, for instance.

Besides, one having ordinary skill in the art may remove the filter circuit 510 in view of design considerations, and instead employ the first processing unit 420 to execute the functions of the filter circuit 510. For example, in another embodiment, the first processing unit 420 may process the audio data to generate the sound signal, and the sound signal is the second frequency signal. Moreover, the first processing unit 420 transmits the second frequency signal to the speaker module 140, so that the speaker module 140 generates the second frequency sound.

Figure 6:
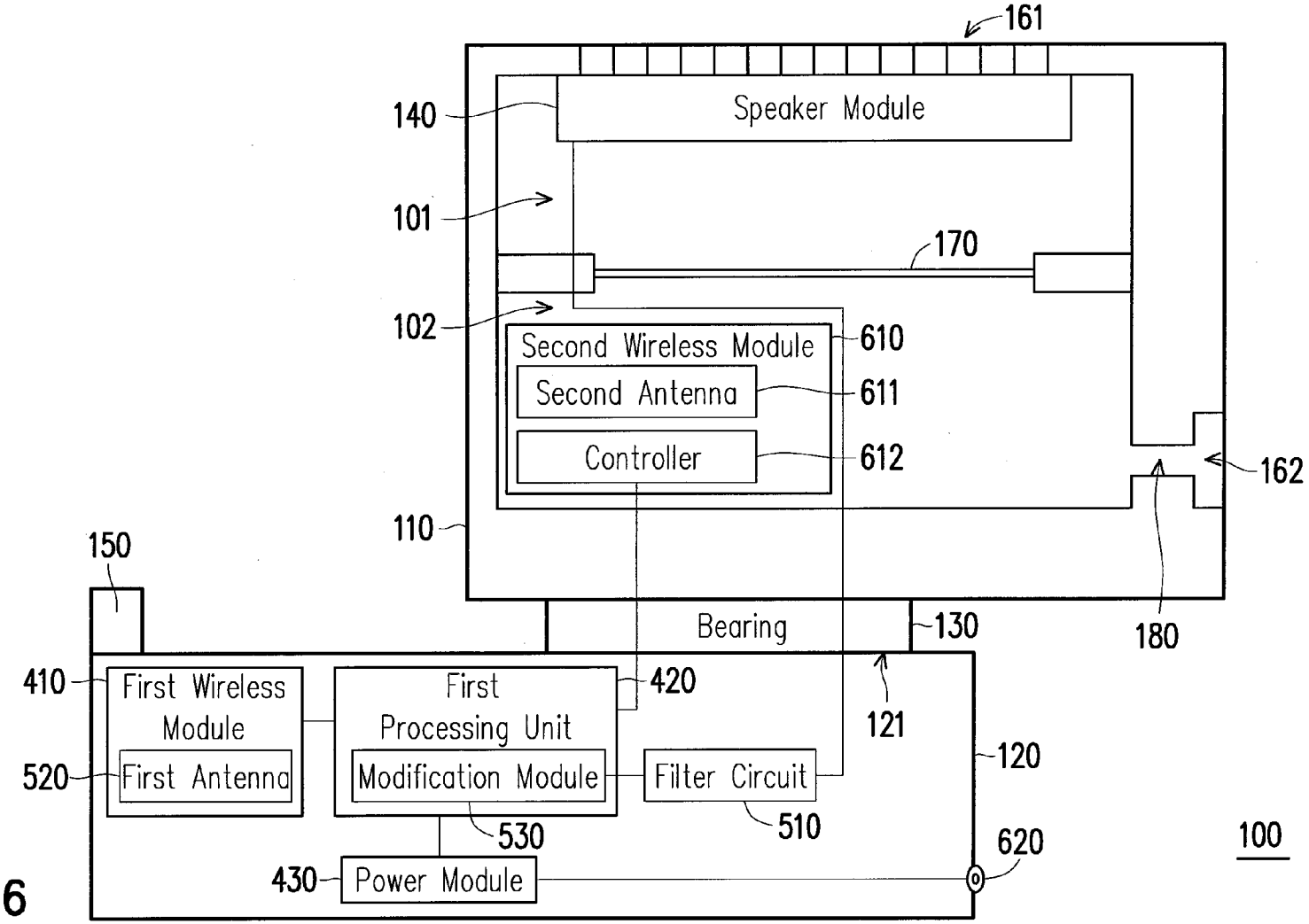
FIG. 6 is a schematic structural view of an electronic device according to another embodiment of the invention.

FIG. 6 is a schematic structural view of an electronic device according to another embodiment of the invention. The electronic device 100 depicted in FIG. 6 is an extension of the embodiment exemplified in FIG. 5. A difference between the two lies in that, the electronic device 100 in FIG. 6 further includes a second wireless module 610 disposed in the first housing 110.

Moreover, in the embodiment depicted in FIG. 6, the second housing 120 has a power socket 620. The power socket 620 is coupled to the power module 430, and the power socket 620 is adapted to receive a power plug of a charger for charging the power module 430. In addition, the second housing may be further configured with a button. The button is coupled to the power module 430 and the first processing unit 420, and the button is used to turn on the power module 430 or the first processing unit 420.

The second wireless module 610 uses a second communication protocol to receive a second wireless signal, and the second wireless module 610 includes a second antenna 611 and a controller 612. The second communication protocol may be a near field communication (NFC) protocol, the second antenna 611 may be a NFC antenna, and the controller 612 may be a NFC controller, for instance. Moreover, in actual implementations, the second antenna 611 is located near the speaker module 140 or surrounds the speaker module 140, so as to reduce the effect of the speaker module 140 on the second antenna 611.

In operation, when the controller 612 receives the second wireless signal through the second antenna 611, the controller 612 triggers the first processing unit 420 and the first wireless module 410, so that the first processing unit 420 switches from a first mode to a second mode. For example, in response to a trigger signal of the controller 612, the first processing unit 420 switches from the initial first mode (e.g. a power saving mode) to the second mode (e.g. an operating mode). In the second mode, the first processing unit 420 generates a third wireless signal through the first wireless module 410 to establish a wireless connection with the handheld electronic device.

In the electronic system, as shown in FIG. 2, the electronic device 100 receives the second wireless signal from the handheld electronic device 200, and the electronic device 100 returns the third wireless signal to the handheld electronic device 200. Accordingly, the handheld electronic device 200 can wake the first processing unit 420 and the first wireless module 410 in the electronic device 100 through the second wireless signal. Moreover, the handheld electronic device 200 establishes the wireless connection with the electronic device 100 through the third wireless signal returned by the electronic device 100. After the wireless connection is established between the handheld electronic device 200 and the electronic device 100, the handheld electronic device 200 emits the first wireless signal carrying the audio data to the electronic device 100, so as to emit the corresponding sounds through the electronic device 100.

Figure 7:
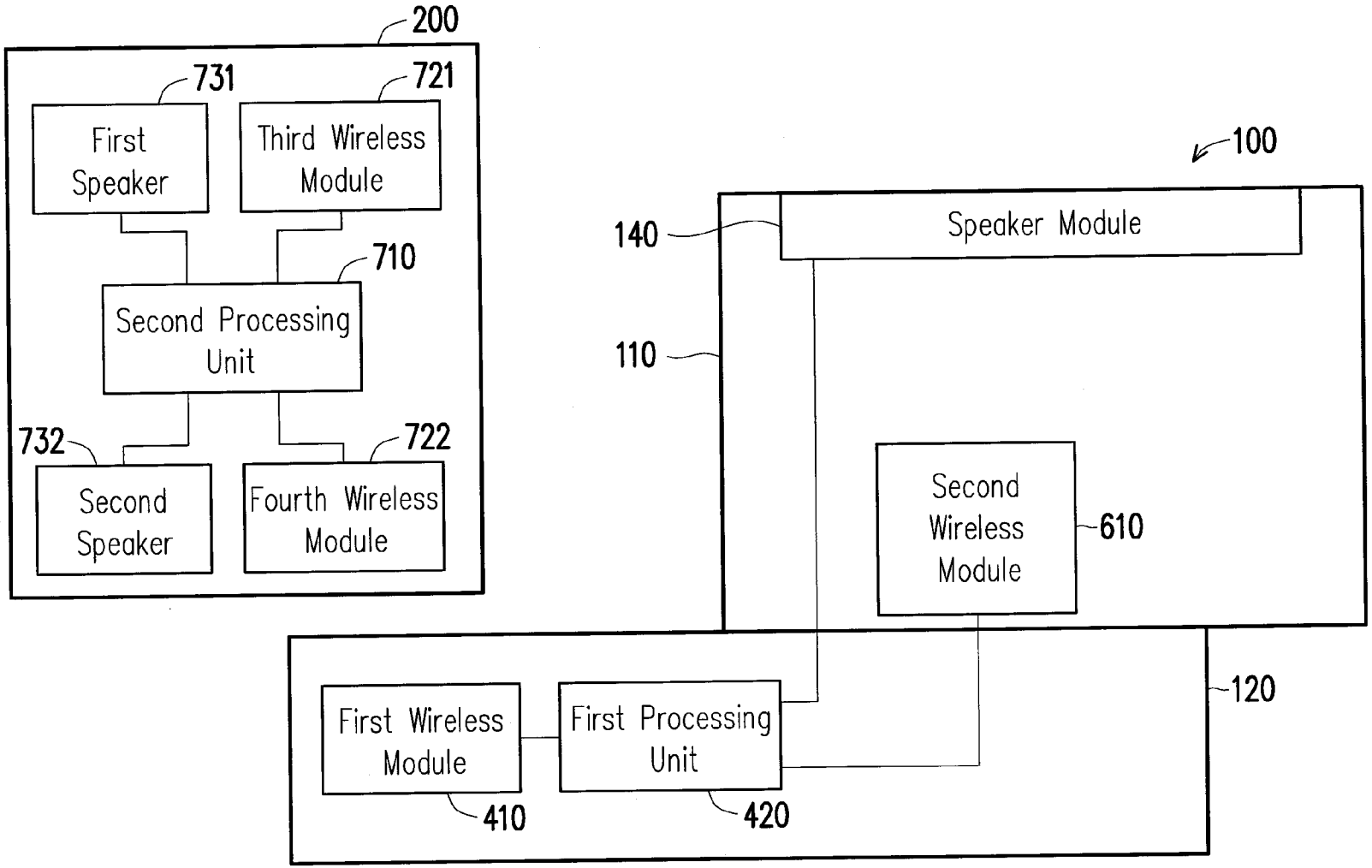
FIG. 7 is a schematic block diagram of an electronic system according to an embodiment of the invention.

In order to further illustrate the electronic system formed by the electronic device and the handheld electronic device to one skilled in the art, FIG. 7 is a schematic block diagram of an electronic system according to an embodiment of the invention. As shown in FIG. 7, the handheld electronic device 200 includes a second processing unit 710, a third wireless module 721, a fourth wireless module 722, a first speaker 731, and a second speaker 732.

The fourth wireless module 722 uses the second communication protocol to emit the second wireless signal. Accordingly, the handheld electronic device 200 may transmit the second wireless signal to the electronic device 100 through the fourth wireless module 722. The electronic device 100 correspondingly receives the second wireless signal through the second wireless module 610. When the second wireless module 610 receives the second wireless signal, the second wireless module 610 triggers the first processing unit 420 and the first wireless module 410. The first processing unit 420 switches to the second mode (e.g. the operating mode), and the first processing unit 420 generates the third wireless signal through the first wireless module 410.

On the other hand, the handheld electronic device 200 receives the third wireless signal through the third wireless module 721. When the third wireless module 721 receives the third wireless signal, the third wireless module 721 establishes a wireless connection with the first wireless module 410. Furthermore, the second processing unit 710 generates the audio data and carries the audio data on the first wireless signal. Accordingly, when the wireless connection between the third wireless module 721 and the first wireless module 410 is established, the third wireless module 721 uses the first communication protocol to transmit the first wireless signal to the first wireless module 410 in the electronic device 100, so that the electronic device 100 generates corresponding sounds in response to the audio data.

It should be noted that, as shown in FIGS. 5 and 6, the electronic device 100 may playback sound of a certain specific band. In other words, the handheld electronic device 200 may strengthen the sounds in a certain specific band (e.g. low frequency sounds) through the electronic device 100, and the handheld electronic device 200 may use an internal speaker to playback the sounds under the rest of the bands (e.g. mid and high frequency sounds).

For example, the second processing unit 710 in the handheld electronic device 200 may process the audio data to generate a first frequency signal. Moreover, the second processing unit 710 transmits the first frequency signal to the first speaker 731 and the second speaker 732. The first speaker 731 and the second speaker 732 generate a first frequency sound according to the first frequency signal. Accordingly, the handheld electronic device 200 may playback the second frequency sound through the electronic device 100, and the handheld electronic device 200 may playback the first frequency sound through the internal speakers 731 and 732.

The second frequency signal may include a mid frequency signal and a high frequency signal, for instance. A frequency range of the mid frequency signal may be between 200 Hz-4000 Hz, for example, and a frequency range of the high frequency signal may be between 4000 Hz-20000 Hz. On the other hand, the first frequency sound may include a mid frequency sound and a high frequency sound, for instance. In other words, in one embodiment, the handheld electronic device 200 may playback the low frequency sounds through the electronic device 100, and the handheld electronic device 200 may playback the high-mid frequency sounds (e.g. mid frequency sounds and high frequency sounds) through the internal speakers 731 and 732.

It should be noted that, the electronic system may also be switched to an automatic modification mode. In the automatic modification mode, the first wireless signal has a signal intensity value, such as a received signal strength indication (RSSI) value. Moreover, the first processing unit 410 modifies a volume of the speaker module 140 according to the signal intensity value.

For example, the handheld electronic device 200 may use the third wireless signal returned by the electronic device 100 to estimate a distance between the electronic device 100 and the handheld electronic device 200, and the handheld electronic device 200 may generate the signal intensity value according to an estimation result. Furthermore, the handheld electronic device 200 carries the signal intensity value on the first wireless signal. When the first processing unit 420 and the first wireless module 410 in the electronic device 100 are wakened, the first processing unit 410 receives the first wireless signal through the first wireless module 410, and the first processing unit 410 modifies the volume of the speaker module 140 according to the signal intensity value in the first wireless signal.

Accordingly, when the distance between the electronic device 100 and the handheld electronic device 200 increases, the signal intensity value generated by the handheld electronic device 200 correspondingly decreases, so that the electronic device 100 increases the volume of the speaker module 140. On the other hand, when the distance between the electronic device 100 and the handheld electronic device 200 decreases, the signal intensity value generated by the handheld electronic device 200 correspondingly increases, so that the electronic device 100 lowers the volume of the speaker module 140.

In other words, under the automatic modification mode, the speaker module 140 in the electronic device 100 reduces or increases the volume according to whether the handheld electronic device 200 approaches or becomes farther away. It should be noted that, the electronic device 100 may modify the volume of the speaker module 140 by using a magnitude of a single signal intensity value. Furthermore, in another embodiment, the electronic device 100 may use a comparison between a plurality of signal intensity values to determine a numerical variation of the signal intensity values, and the electronic device 100 may modify the volume of the speaker module 140 according to the numerical variation of the signal intensity values.

In addition, the handheld electronic device 200 may also modify the volume of the speaker module 140 through modifying an amplitude data in the audio data. For example, in one embodiment, the audio data has an amplitude data, and the handheld electronic device 200 may modify the amplitude data according to the signal intensity value. On the other hand, the first processing unit 420 in the electronic device 100 processes the audio data according to the amplitude data, and accordingly generates the sound signal. Accordingly, when the handheld electronic device 200 lowers the magnitude of the amplitude data, the electronic device 100 correspondingly reduces the sound signal, so that the sound generated by the speaker module 140 is also correspondingly reduced.

Furthermore, the handheld electronic device 200 may also additionally transmit a volume control information to modify the volume of the electronic device 100 through the wireless transmission between the third wireless module 721 and the first wireless module 410. For instance, the handheld electronic device 200 may transmit the volume control information to the first wireless module 410 in the electronic device 100 through the third wireless module 721, so that the first processing unit 420 in the electronic device 100 modifies the volume of the speaker module 140 according to the volume control information.

In view of the foregoing, embodiments of the invention employ the bearing to drive the first housing and the second housing to slide relative to each other, so that the electronic device can selectively expose a portion of the bearing surface of the second housing. Moreover, when a portion of the bearing surface of the second housing is exposed, the handheld electronic device may be placed on the bearing surface, thereby enhancing the convenience of using the electronic device. Besides, since the first housing in the invention uses two resonant chambers to generate resonance, the sound field effect of the electronic device can be enhanced in the limited space, thereby facilitating the miniaturization of the electronic device.

Although the invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. An electronic device, comprising:

a first housing having a first hole;

a speaker module disposed in the first housing, a sound generated by the speaker module being transmitted out of the electronic device through the first hole;

a second housing having a bearing surface facing to the first housing; and a bearing disposed between the first housing and the second housing, the second housing and the first housing moving relative to each other by using the bearing, so that the first housing covers or exposes a portion of the bearing surface, wherein the first housing comprises a resonant film, a first resonant chamber, and a second resonant chamber, the resonant film is disposed in the first housing and located between the first resonant chamber and the second resonant chamber, the first resonant chamber is an airtight space, the second resonant chamber has a channel, the second resonant chamber is connected to outside of the first housing through the channel and a second hole of the first housing, and the speaker module is located in the first resonant chamber.

2. The electronic device according to claim 1, wherein the electronic device further comprises:

a protrusion disposed on the bearing surface.

3. The electronic device according to claim 1, wherein the bearing comprises:

a first sliding element connected to the first housing;

a second sliding element connected to the bearing surface of the second housing, the second sliding element moving between a first position and a second position of the first sliding element; and an elastic element connected between the first sliding element and the second sliding element, the elastic element providing an elastic force causing the second sliding element to move to the first position or the second position.

4. The electronic device according to claim 1, further comprising:

a first wireless module receiving a first wireless signal having an audio data; and a first processing unit coupled to the first wireless module and the speaker module, the first processing unit processing the audio data to generate a sound signal, wherein the speaker module generates the sound according to the sound signal.

5. The electronic device according to claim 4, wherein the first processing unit comprises:

a modification module modifying the audio data and generating the sound signal according to the modified audio data.

6. The electronic device according to claim 5, further comprising:

a filter circuit disposed in the second housing and coupled to the modification module and the speaker module, the filter circuit performing a filtering process on the sound signal to generate the sound signal in a specific band.

7. The electronic device according to claim 4, further comprising:

a second wireless module disposed in the first housing and coupled to the first processing unit, the second wireless module receiving a second wireless signal, wherein when the second wireless module receives the second wireless signal, the second wireless module triggers the first processing unit and the first wireless module, and the first processing unit generates a third wireless signal through the first wireless module for establishing a wireless connection with a handheld electronic device.

8. An electronic system, comprising:

an electronic device comprising a first housing having a first hole, a speaker module disposed in the first housing, a sound generated by the speaker module being transmitted out of the electronic device through the first hole, a second housing having a bearing surface facing to the first housing, a bearing disposed between the first housing and the second housing, the bearing driving the second housing and the first housing to move relative to each other, so that the first housing covers or exposes a portion of the bearing surface of the second housing, a first wireless module receiving a first wireless signal having an audio data, and a first processing unit coupled to the first wireless module and the speaker module, the first processing unit processing the audio data to generate a sound signal, wherein the speaker module generates the sound according to the sound signal; and a handheld electronic device comprising a second processing unit generating the audio data, and a third wireless module coupled to the second processing unit, the third wireless module generating the first wireless signal, wherein the first housing comprises a resonant film a first resonant chamber and a second resonant chamber, the resonant film is disposed in the first housing and located between the first resonant chamber and the second resonant chamber, the first resonant chamber is an airtight space, the second resonant chamber has a channel, the second resonant chamber is connected to outside of the first housing through the channel and a second hole of the first housing, and the speaker module is located in the first resonant chamber.

9. The electronic system according to claim 8, further comprising:

a second wireless module disposed in the first housing and coupled to the first processing unit, the second wireless module receiving a second wireless signal, wherein when the second wireless module receives the second wireless signal, the second wireless module triggers the first processing unit and the first wireless module, and the first processing unit generates a third wireless signal through the first wireless module.

10. The electronic system according to claim 9, wherein when the handheld electronic device receives the third wireless signal, the handheld electronic device establishes a wireless connection with the first wireless module.

11. The electronic system according to claim 9, wherein the handheld electronic device further comprises:

a fourth wireless module generating the second wireless signal, wherein the second processing unit is coupled to the third wireless module and the fourth wireless module, and when the third wireless module receives the third wireless signal, the third wireless module establishes a wireless connection with the first wireless module.

12. The electronic system according to claim 8, wherein the second processing unit processes the audio data to generate a first frequency signal, and the handheld electronic device further comprises:

a first speaker generating a first frequency sound according to the first frequency signal, wherein the sound signal generated by the first processing unit is a second frequency signal, and the first processing unit transmits the second frequency signal to the speaker module, so that the sound generated by the speaker module is a second frequency sound.

13. The electronic system according to claim 8, wherein the first wireless signal has a signal intensity value, and the first processing unit modifies a volume of the speaker module according to the signal intensity value.

14. The electronic system according to claim 13, wherein the audio data has an amplitude data, the handheld electronic device modifying the amplitude data according to the signal intensity value, the first processing unit generating the sound signal according to the modified amplitude data, and the speaker module generating the sound according to the sound signal.

15. The electronic system according to claim 8, wherein the audio data has a volume control information, and the first processing unit modifies the volume of the speaker module according to the volume control information.

16. The electronic system according to claim 8, wherein the electronic device further comprises:

a protrusion disposed on the bearing surface and located near an edge of the bearing surface, wherein when the bearing surface of the second housing is exposed, the handheld electronic device is placed on the bearing surface, and the protrusion stops the handheld electronic device from sliding out of the edge of the bearing surface.

* * * * *